United States Patent [19]

Nickels

[11] Patent Number: 4,984,834

[45] Date of Patent: Jan. 15, 1991

[54] PORTABLE SECURITY LOCK

[76] Inventor: James G. Nickels, 5808 Calhoun, Dearborn, Mich. 48126

[21] Appl. No.: 507,042

[22] Filed: Apr. 10, 1990

[51] Int. Cl.[5] ..... E05C 19/18

[52] U.S. Cl. ..... 292/297; 292/257

[58] Field of Search ..... 292/244, 297, 296, 292, 292/290, 298, 257, DIG. 7

[56] References Cited

U.S. PATENT DOCUMENTS

| | | | |
|---|---|---|---|
| 866,681 | 9/1907 | Powell | 292/290 |
| 869,541 | 10/1907 | Baxter | 292/297 |
| 3,257,137 | 6/1966 | von Duyke | 292/298 |
| 4,589,692 | 5/1986 | Boyd | 292/297 |

*Primary Examiner*—Richard E. Moore

*Attorney, Agent, or Firm*—Charles W. Chandler

[57] ABSTRACT

A portable door lock that includes a tension plate insertable into the clearance space between the edge of a door and the facing surface of a door jamb. Ears on the plate hook into a striker plate opening. A door keeper element is swingably connected to the tension plate for movement against the exposed face of the door. The door-engagement surface of the keeper element is a cam surface adapted to move angularly along the door face at a relatively slight angle, such that the keeper element assumes a wedged condition. The cam surface gives the keeper element an adjustability that compensates for tolerance variations in the spacing between the door face and the striker plate opening.

8 Claims, 1 Drawing Sheet

PORTABLE SECURITY LOCK

BACKGROUND AND SUMMARY OF THE INVENTION

This invention relates to a portable security lock for doors. The lock is detachable from any door such that it can be carried to any location where a portable door lock might be needed, e.g. a hotel room door, or any room door not equipped with a permanent locking mechanism.

In some respects, structures of the present invention are similar to portable door locks shown in U.S. Pat. No. 1,074,230 to H. Wiseman, U.S. Pat. No. 1,176,069 to A. Lockhead, U.S. Pat. No. 831,235 to J. Nash, U.S. Pat. No. 618,844 to C. Corey, and U.S. Pat. No. 4,169,619 to J. McCracken. A distinguishing feature of the present invention is a door keeper element formed with an arcuate cam surface centered around a point offset slightly from the swing axis of the keeper element, such that swinging movement of the door keeper element causes the arcuate cam surface to move angularly along the door surface to a wedged condition.

The wedge feature of the newly invented lock compensates for slight differences in door-jamb relationships, e.g. door thickness variations or variations in positionment of the strike plate in relation to the door outer face. The portable lock can be used wherever a portable door lock might be needed without fear that the lock might not fit onto a particular door.

Another advantage of the wedge construction is that a tight fit is obtained between the doorkeeper element and the door face. This avoids any rattle or play between the door and keeper element, such as might lead to dislodgement of the portable lock or a feeling of uneasiness (unsafeness) on the part of the user.

The door keeper does not damage the door structure. The cam accommodates variations in the door strike plate structure and the inside face of the door dimension. The lock does not engage the door trim and is useful independently of the trim structure shape.

THE DRAWING

DESCRIPTION OF A PREFERRED EMBODIMENT OF THE INVENTION

Figure 1:
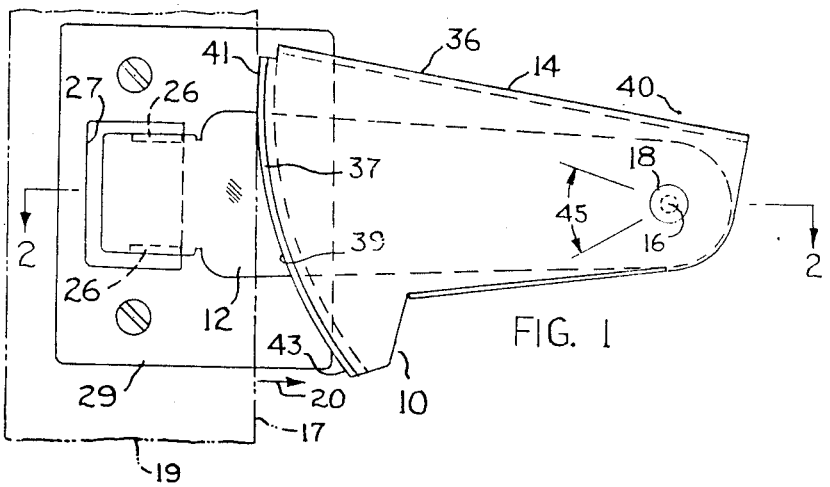
FIG. 1 is a side elevational view of a portable door lock embodying the invention. The lock is shown in an installed position on a door (illustrated in dashed lines).

The drawings show a portable door lock 10 that comprises an elongated flat plate 12 and a door keeper element 14. The door keeper element is swingably attached to plate 12 for folding-unfolding movements around a swing axis 16. A rivet 18 extends through overlapped areas of plate 12 and keeper element 14 to define the swing axis.

Figure 2:
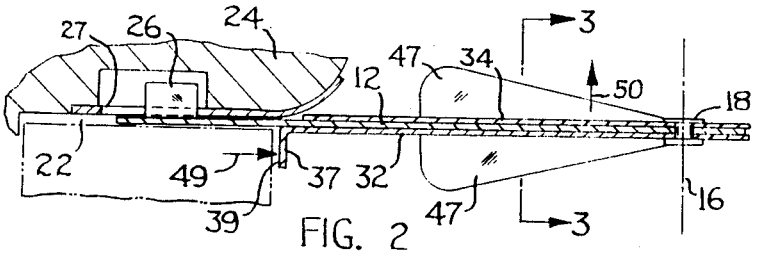
FIG. 2 is a sectional view taken on line 2—2 of FIG. 1.

FIG. 1 shows door keeper element 14 in a folded position engaged with face 17 of a door 19 (shown in dashed lines); the keeper element is in a wedged condition for preventing the door from opening in the arrow 20 direction. As shown in FIGS. 1 and 2, plate 12 extends into a clearance space 22 between the free edge of the door and the facing surface of a door jamb 24. Plate 12 has two projecting ears 26 disposed in an opening 27 in a strike plate 29 carried on door jamb 24, such that plate 12 is temporarily anchored against being pulled out from clearance space 22.

Figure 4:
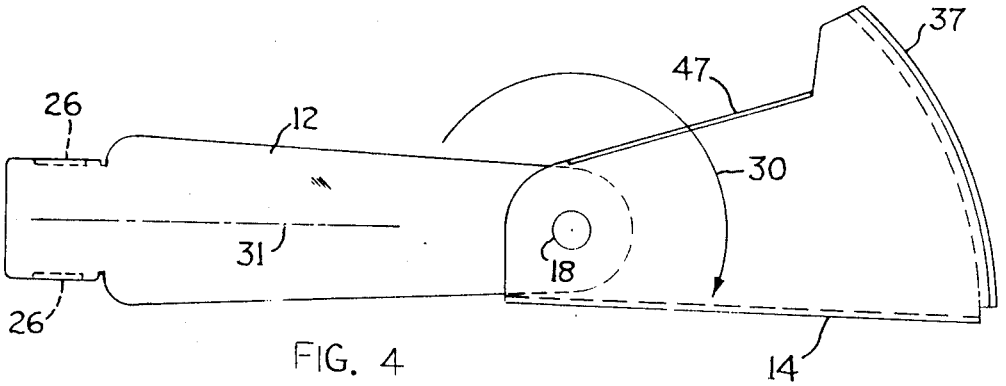
FIG. 4 is a side elevational view taken in the same direction as FIG. 1, but showing the door lock in an unfolded condition detached from a door.

FIG. 4 shows door keeper element 14 in an unfolded condition, swung around axis 16 through an arc of about one hundred eighty degrees, as designated by arrow 30.

As shown in FIG. 2, plate 12 is horizontally elongated, with ears 26 extending right angularly from one end portion of the plate, and with swing connection (rivet) 18 at the other end portion of the plate. Ears 26 are located in parallel planes extending parallel to an imaginary longitudinal axis line 31 drawn from swing axis 16 through a point midway between the ears. This relationship ensures that the plate will extend normal to the closed door plane when the plate is inserted into clearance space 22.

Figure 3:
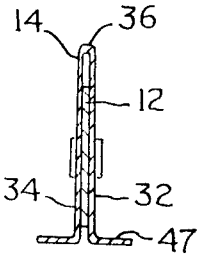
FIG. 3 is a sectional view taken on line 3—3 in FIG. 2.

Door keeper element 14 comprises two flat parallel walls 32 and 34 spaced apart substantially the same distance as the intervening flat plate 12. A web wall 36 connects the two walls 32 and 34 such that the keeper element has a U cross-section, as viewed in FIG. 3. Rivet 18 extends through walls 32 and 34, and plate 12, to form a swingable connection.

A cam wall 37 extends right angularly from wall 32 remote from swing axis 16. The cam wall defines an arcuate cam surface 39 centered around an imaginary point 40 offset slightly from swing axis 16. This offset relationship causes points along the cam surface to be spaced different distances from swing axis 16. For example, one end area 41 of the cam surface can be spaced from swing axis 16 by a distance of about one and thirteen sixteenth inches, whereas the other end area 43 of the cam surface can be spaced from swing axis 16 by a distance of only about one and seven sixteenth inches. The differential between these two dimensions is three eighths of an inch. This differential represents the adjusting distance available to compensate for variations in door-jamb tolerances, from one installation to another installation.

Cam surface 39 preferably has a fairly long arc distance, e.g. approximately about fifty degrees, as measured around swing axis 16. Numeral 45 in FIG. 1 represents the arc length of surface 39. A fairly long cam surface is desirable in that the cam surface can then have a relatively slight (gradual) angular approach along door face 19 during swinging motion of keeper element 14 to the FIG. 1 position.

To install the door lock, keeper element 14 is swung back to the unfolded condition (FIG. 4), and plate 12 is placed flat against the surface of strike plate 29 with door 19 in an opened condition. Plate 12 is held against strike plate 29 with ears 26 extending into opening 27. At the same time door 19 is moved to the closed position, such that plate 12 is located within clearance space 22 between the door and plate 29. After the door is fully closed, keeper element 14 is swung in a counterclockwise arc to the FIG. 1 position. Cam surface 39 progresses angularly along door face 17 until it is in a wedged condition.

The exact final position of the keeper element 14 is determined by the distance between door face 17 and striker plate opening 27. This distance can vary slightly from one installation to another. However, cam surface 39 compensates for such variations. Keeper element 14 is shown with cam surface 39 engaged against the door at a point near end area 41 of the cam surface. In a different installation, the cam surface might engage the door at a point near end area 43 of the cam surface or at an intermediate point along the cam surface. In its final position, keeper element 14 seats tightly against the door face, such that the door is prevented from rattling or shifting relative to the lock device.

Removal of the portable lock is accomplished by swinging keeper element 14 in a clockwise arc from the FIG. 1 position to the FIG. 4 position. After the cam surface is disengaged from the door face, the door can be opened to permit plate 12 to be drawn away from strike plate 29.

In preferred practice of the invention, keeper element 14 is formed with two handle elements 47 extending right angularly from walls 32 and 34. These handle elements facilitate manual swinging motions of keeper element 14, and a relatively tight wedge fit of cam surface 39 against door face 17. Keeper element 14 is preferably formed as a one piece metal stamping having a wall thickness of about 0.04 inch. Plate 12 has a similar wall thickness.

Keeper element 14 could be formed as a single wall 32 and associated cam wall 37 (i.e. without wall 34 or connecting web 36). However, such a structure would not have the same resistance against bending or dislodgement. In this connection, it should be noted that an intruder force will be applied along a line 49 (FIG. 2) slightly offset from the plane of plate 12. This offset produces a force tending to bend plate 12 in the arrow 50 direction. However, wall 34 of the keeper element resists such a bending force. The U-shaped wall cross section (FIG. 3) of the illustrated keeper element provides a reinforcement against intruder break that cannot be provided by a single wall keeper element, as shown e.g. in U.S. Pat. No. 4,169,619.

U.S. Pat. No. 1,074,230 to H. Wiseman shows a door lock having a keeper element formed with a U-shaped cross section. The Wiseman patent however lacks the arcuate cam surface that I propose for achievement of a wedge fit of the keeper element against a door face.

The proposed door lock is strengthened somewhat by the fact that ears 26 have edge contact with the edge of strike plate opening 27. Pull out forces applied to plate 12 will be resisted by the full length dimensions of ears 26 (FIG. 2). In prior art arrangements, a single ear is used in an orientation where the pull-out force can bend the ear so that it comes out of the strike plate opening. This is not possible with my proposed ear orientation.

The illustrated device can be used with doors of the "right opening" type or the "left opening" type. In one case, ears 26 will extend into the plane of the paper (FIG. 4) so that keeper element 14 is swung counterclockwise to engage the door. In the other case, ears 26 will extend out from the plane of the paper (FIG. 4) so that keeper element 14 is swung clockwise to engage the door.

The drawings necessarily show one particular form of the invention. However, it will be appreciated that some variations maybe resorted to while still practicing the invention.

What is claimed is:

1. A portable door lock comprising an elongated flat plate having one end portion thereof adapted to be inserted edgewise into a clearance space between the edge of a door and the facing surface of a door jamb; said one end portion of the flat plate having an ear means extending right angularly therefrom for entry into an opening in a strike plate carried on said facing surface of the door jamb; said elongated flat plate having its other end portion spaced away from the door when said plate is inserted into the clearance space; a door keeper element swingably connected to said flat plate near said other end portion of the plate; said door keeper element comprising at least one flat wall facially engaged with said flat plate for swinging slidable movement therealong, and a cam wall extending right angularly from said one wall; said cam wall having an arcuate cam surface adapted to engage a major face of the door when said ear means is engaged in the strike plate opening and the door is in a closed position; said arcuate cam surface being centered around a point offset slightly from the swing axis of the door keeper element, whereby swinging movement of the keeper element causes the arcuate cam surface to move angularly along the door face to a wedged condition; said arcuate cam surface having end areas thereof spaced different distances from the door keeper element swing axis, the distance differential being approximately three eighths of an inch.

2. The door lock of claim 1, wherein said arcuate cam surface has an arc length of approximately fifty degrees measured around the keeper element swing axis.

3. A portable door lock comprising an elongated flat plate having one end portion thereof adapted to be inserted edgewise into a clearance space between the edge of a door and the facing surface of a door jamb; said one end portion of the flat plate having an ear means extending right angularly therefrom for entry into an opening in a strike plate carried on said facing surface of the door jamb; said elongated flat plate having its other end portion spaced away from the door when said plate is inserted into the clearance space; a door keeper element swingably connected to said flat plate near said other end portion of the plate; said door keeper element comprising two flat parallel walls spaced apart so that each wall is facially engaged with one face of the plate for swinging slidably movement therealong, and a web wall interconnecting said parallel walls; said door keeper element further comprising a cam wall extending right angularly from one of said parallel walls; said cam wall having an arcuate cam surface adapted to engage a major face of the door when said ear means is engaged in the strike plate opening and the door is in a closed position; said arcuate cam surface being centered around a point offset slightly from the swinging axis of the door keeper element whereby swinging movement of the keeper element causes the arcuate cam surface to move angularly along the door face to a wedged condition; said arcuate cam surface having end areas thereof spaced different distance from the door keeper element swing axis; the distance differential being about three eighths of an inch.

4. The door lock of claim 2, wherein said arcuate cam surface has an arc length of approximately fifty degrees measured around the keeper element swing axis.

5. The door lock of claim 3, and further comprising the handle elements extending right angularly from said parallel walls at points spaced from the keeper element swing axis.

6. The door lock of claim 5, wherein the door keeper element is a one piece metal stamping.

7. The door lock of claim 5, wherein said web wall extends along one entire edge of each associated flat wall.

8. A portable door lock comprising an elongated flat plate having one end portion thereof adapted to be inserted edgewise into a clearance space between the edge of a door and the facing surface of a door jamb; said one end portion of the flat plate having an ear means extending right angularly therefrom for entry into an opening in a strike plate carried on said facing surface of the door jamb; said elongated flat plate having its other end portion spaced away from the door when said plate is inserted into the clearance space; a door keeper element swingably connected to said flat plate near said other end portion of the plate; said door keeper element comprising at least one flat wall facially engaged with said flat plate for swinging slidably movement therealong; and a cam wall extending right angularly from said one wall; said cam wall having an arcuate cam surface adapted to engage a major face of the door when said ear means is engaged in the strike plate opening and the door is in a closed position; said arcuate cam surface being centered around a point (40) offset from the swing axis of the door keeper element; the distance between the cam surface center point and the cam surface being slightly greater than the distance between the keeper element swing axis and a point midway along the cam surface, whereby swinging movement of the keeper element causes the arcuate cam surface to move angularly along the door face to a wedged condition.

* * * * *